US006374581B1

(12) United States Patent
Bonnain et al.

(10) Patent No.: US 6,374,581 B1
(45) Date of Patent: Apr. 23, 2002

(54) FEEDER MECHANISM AND HOPPER FOR TWO DIFFERENT TYPES OF CARTONS

(75) Inventors: Jean-Christophe Bonnain; Jean-Jacques Dussart, both of Chateauroux; Philippe Eblin, St-Maur, all of (FR)

(73) Assignee: The Mead Corporation, Dayton, OH (US)

( * ) Notice: Subject to any disclaimer, the term of this patent is extended or adjusted under 35 U.S.C. 154(b) by 0 days.

(21) Appl. No.: 09/509,028

(22) PCT Filed: Sep. 21, 1998

(86) PCT No.: PCT/US98/19523

§ 371 Date: May 26, 2000

§ 102(e) Date: May 26, 2000

(87) PCT Pub. No.: WO99/14126

PCT Pub. Date: Mar. 25, 1999

(30) Foreign Application Priority Data

Sep. 19, 1997 (GB) ..... 9719951

(51) Int. Cl.[7] ..... B65B 3/02
(52) U.S. Cl. ..... 53/458; 53/48.1; 53/389.1
(58) Field of Search ..... 53/458, 457, 48.1, 53/389.1, 48.7, 48.9; 493/315, 317

(56) References Cited

U.S. PATENT DOCUMENTS 3,381,452 A * 5/1968 Gentry et al.
3,751,872 A * 8/1973 Helms ..... 53/458
3,760,554 A * 9/1973 Arneson ..... 53/458
5,027,586 A * 7/1991 Ramaker ..... 53/458
5,061,231 A 10/1991 Dietrich et al. ..... 493/315
5,144,789 A * 9/1992 Focke et al. ..... 53/389.1
5,148,654 A * 9/1992 Kisters ..... 53/48.7
5,507,128 A 4/1996 Johnson et al. ..... 53/48.1
5,511,772 A 4/1996 Ganz et al. ..... 271/12

FOREIGN PATENT DOCUMENTS

| | | |
|---|---|---|
| DE | 1 901 300 | 9/1970 |
| EP | 0 719 706 | 7/1996 |

* cited by examiner

*Primary Examiner*—Rinaldi I. Rada
*Assistant Examiner*—Sameh Tawfik
(74) *Attorney, Agent, or Firm*—Thomas A. Boshinski

(57) ABSTRACT

An apparatus and method for storing two different types of carton, and for selecting and transferring cartons to be packaged, which apparatus includes a first hopper for storing a first carton type, a second hopper for storing a second carton type, and a carton engaging device that provides a first position for engaging cartons from the first hopper and a different second position for engaging cartons from the second hopper. A transfer device transfers the cartons from its respective first or second hopper to the infeed end of a packaging machine.

6 Claims, 8 Drawing Sheets

FEEDER MECHANISM AND HOPPER FOR TWO DIFFERENT TYPES OF CARTONS

This invention relates to packaging of primary articles such as cans and bottles in multiple packaged cartons and is more particularly concerned with feeding such cartons in collapsed condition from a hopper and for initiating and then completing a set up operation of cartons in sequence.

The majority of known packaging machines are dedicated machines which construct only one size of one type of carton. Therefore, modern bottling plants are required to use a plurality of packaging machines to package different carton types, each machine taking up considerable floor space and being expensive to both purchase and operate.

A limited number of packaging machines are capable of packaging different sizes of cartons, for example six, eight or twelve packs of a wraparound carton. All such machines require adjustment when switching from one size or type of carton to another. This adjustment includes the manual removal of all of the cartons within the packaging machine and possible the mechanical adjustment of components in the machine. During this change over period, which can be thirty minutes or more, a machine cannot be used (known as "downtime"), which is an expensive delay in a bottling plant. Such a delay may even result in downtime for the entire bottling line, not just the packaging machine, if problems arise during the changeover period.

The present invention seeks to overcome the commercial disadvantages of known packaging machines by providing a feeder mechanism which is able to set up more than one type of carton. Further, the invention is capable of switching from one carton type to another, or between sizes with minimum downtime. The modular nature of the present invention enables a "fully flexible" machine to be constructed which overcomes, or at least mitigates, the problems of known machines.

The present invention can be used with a packaging machine described in PCT Published Application WO99/14120. It is envisaged that the present invention can be used with various other types of packaging machine. Alternatively, the erecting mechanism of the preset invention can be sold as an individual module to be fitted to new equipment on a retro fit basis.

One aspect of the invention provides an apparatus for storing two different types of carton, and for selecting and transferring cartons to be packaged which apparatus comprises a first hopper for storing a first carton type, a second hopper for storing a second carton type, carton engaging means and transfer means to transfer the carton from its respective first or second hopper from the infeed end of a packaging machine characterized in that said carton engaging and transfer means is rotatable about a fixed axis in an orbital path and in that the carton engaging means incorporates means to provide a first position for engaging cartons from the first hopper and a second position for engaging cartons from the second hopper the first and second pick up positions are located at different points on said orbital path.

According to an optional feature of this aspect of fee invention, the apparatus may further comprise means to place one of said hoppers in an operative position and control means to select the position of carton engagement means corresponding to the operative hopper selected.

According to another optional feature of his aspect of the invention, means to place one of said hoppers in an operative position may comprise a frame mounted to a second fixed axis and wherein said first and second hoppers are mounted to the frame each hopper being oppositely disposed about the second fixed axis.

According to a further optional feature of this aspect of the invention, said operative hopper may be adjacent the orbital path of said carton pick up and transfer means.

According to a still further optional feature of is aspect of the invention the control means may control the hoppers to place them in operative and inoperative positions.

A second aspect of the invention provides a method of selecting cartons held in first or second hoppers and transferring said cartons to the infeed end of a packaging machine which method comprises the steps of selecting one of said hoppers to be operative, placing said hopper in an operative position, positioning a carton engaging means to engage a carton stored in the operative hopper and transferring the engaged carton to said infeed end.

A third aspect of the invention provides an apparatus for storing two different types of carton, comprising a first hopper and a second hopper oppositely disposed about a fixed axis and rotatable between a first position whereby one of said first and second hoppers is in an operative position and a second position whereby the other of said first and second hoppers is in an operative position.

An embodiment of the invention will now be described by way of example with reference to the accompanying drawings in which.

FIG. 1*a* is a side view of a basket type carton supplied in a flat collapsed condition suitable for use with the machine according to the invention;

FIG. 1*b* is a perspective view of a basket type carton suitable for use with the machine according to the invention;

FIG. 2*a* is a perspective view of a fully enclosed carton blank suitable for use with the machine according to the invention;

FIG. 2*b* is a perspective view of an erected and loaded carton of the type illustrated in FIG. 2*a;*

A mechanism according to the present invention is capable of storing and feeding a variety of carton types, for example wraparound, fully enclosed and basket type cartons. Any reference in this specification to carton type includes different sizes of any particular carton style, for example fully enclosed cartons for eight or twelve articles.

Figure 1A:
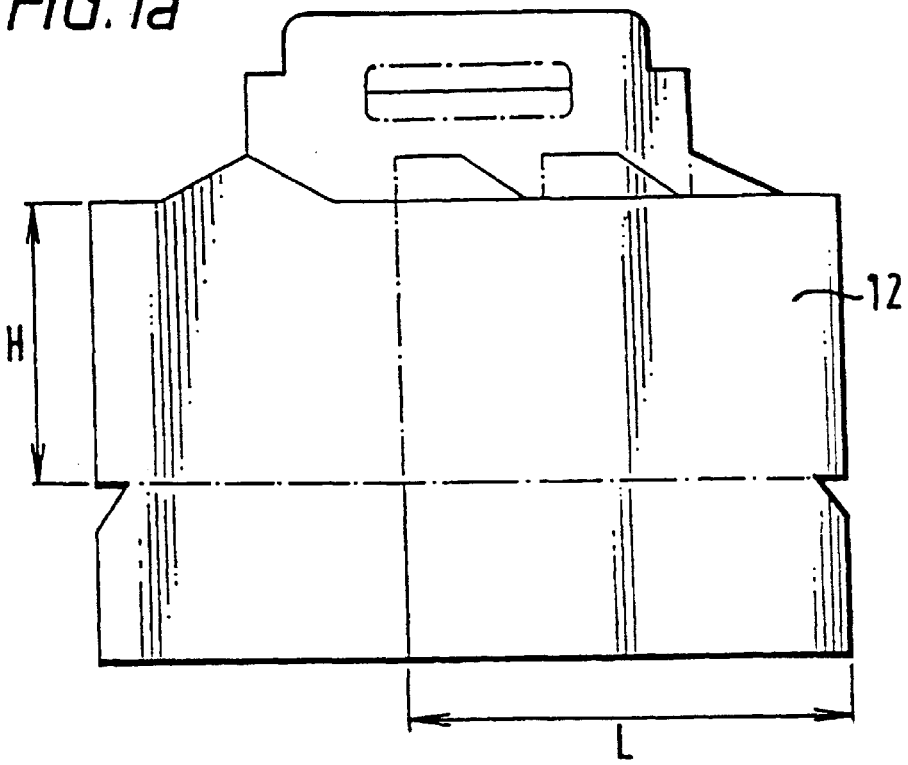
Figure 1B:
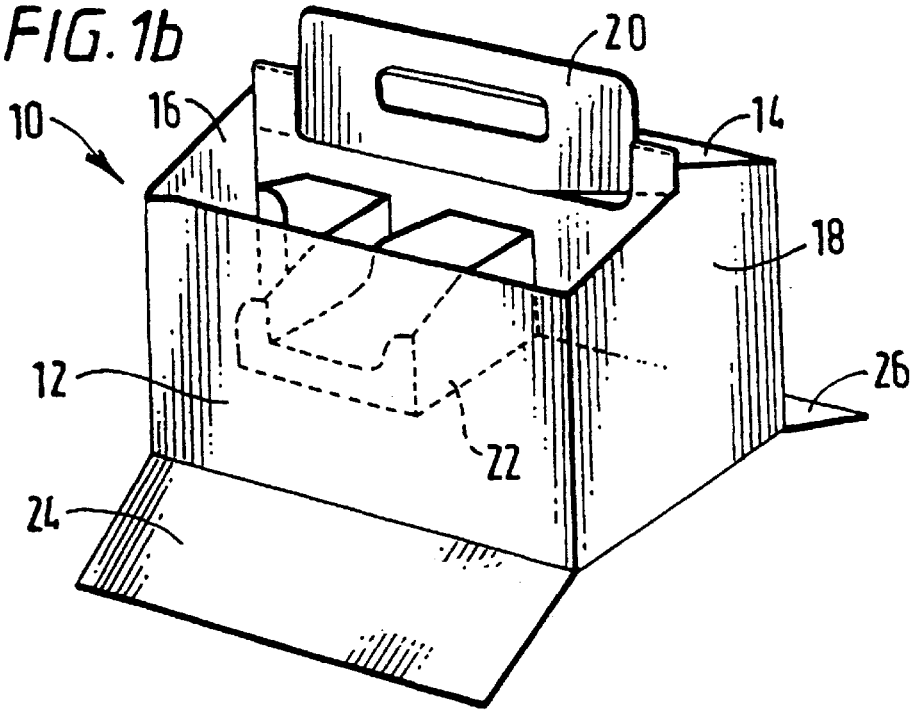

Referring to the drawings, and in particular FIG. 1*a* and 1*b* thereof, carton 10 is a basket type carrier shown in FIG. 1*b* in a set up condition ready for lowering onto articles. The carton 10 includes opposed side wall panels 12, 14 and opposed end wall panels 16, 18 hingeably connected one to the next. The carton further includes a handle structure 20 which inter-connects end wall panels 16, 18 and comprises transverse partition panels 22 inter-connecting each side wall 12, 14. Base panels 24, 26 are hingeably connected to each side wall panel 12, 14 respectively.

Figure 2A:
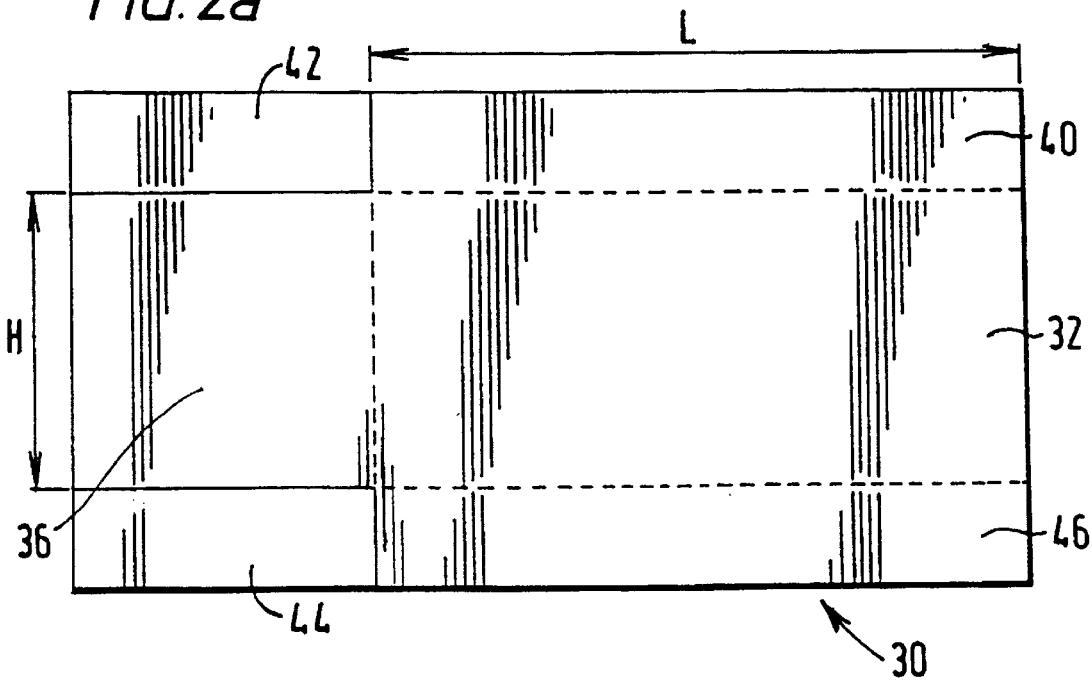
Figure 2B:
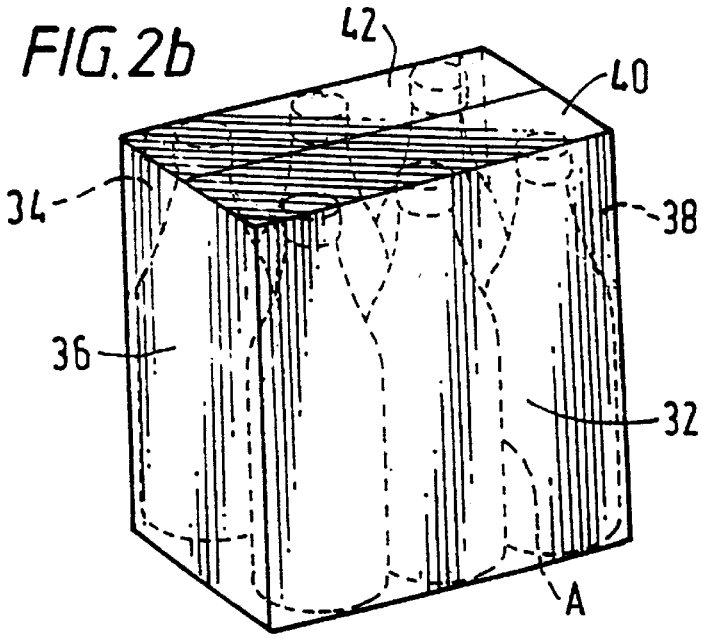

Referring now to FIG. 2*a* and *b* of the drawings carton 30 is a fully enclosed carton, shown in FIG. 2*a* in its flat collapsed form. The carton blank includes opposed side wall panels 32,34 and opposed end wall panels 36, 38 hingeably connected one to next. The carton further comprises top panels 40, 42 and base panels 44, 46 hingeably connected to respective side walls 32, 34. Articles A are inserted into the carton from above or, as the case may be, from below and the top and base panels are then secured together to provide a fully enclosed carton.

It is envisaged that the cartons will vary depending upon the shape and or quantity of articles to be packaged and accordingly, a machine in accordance with the present invention is adjustable in numerous respects so that it can process a wide variety of such cartons. The principal arrangements which are likely to be varied are shown in FIG. 1*a* and 2*a* in which "H" is the overall height of the set up carton equivalent to the distance between the upper edge of the side wall and base panel, "L" is the overall length of the carton when the base panels have closed.

Figure 3:
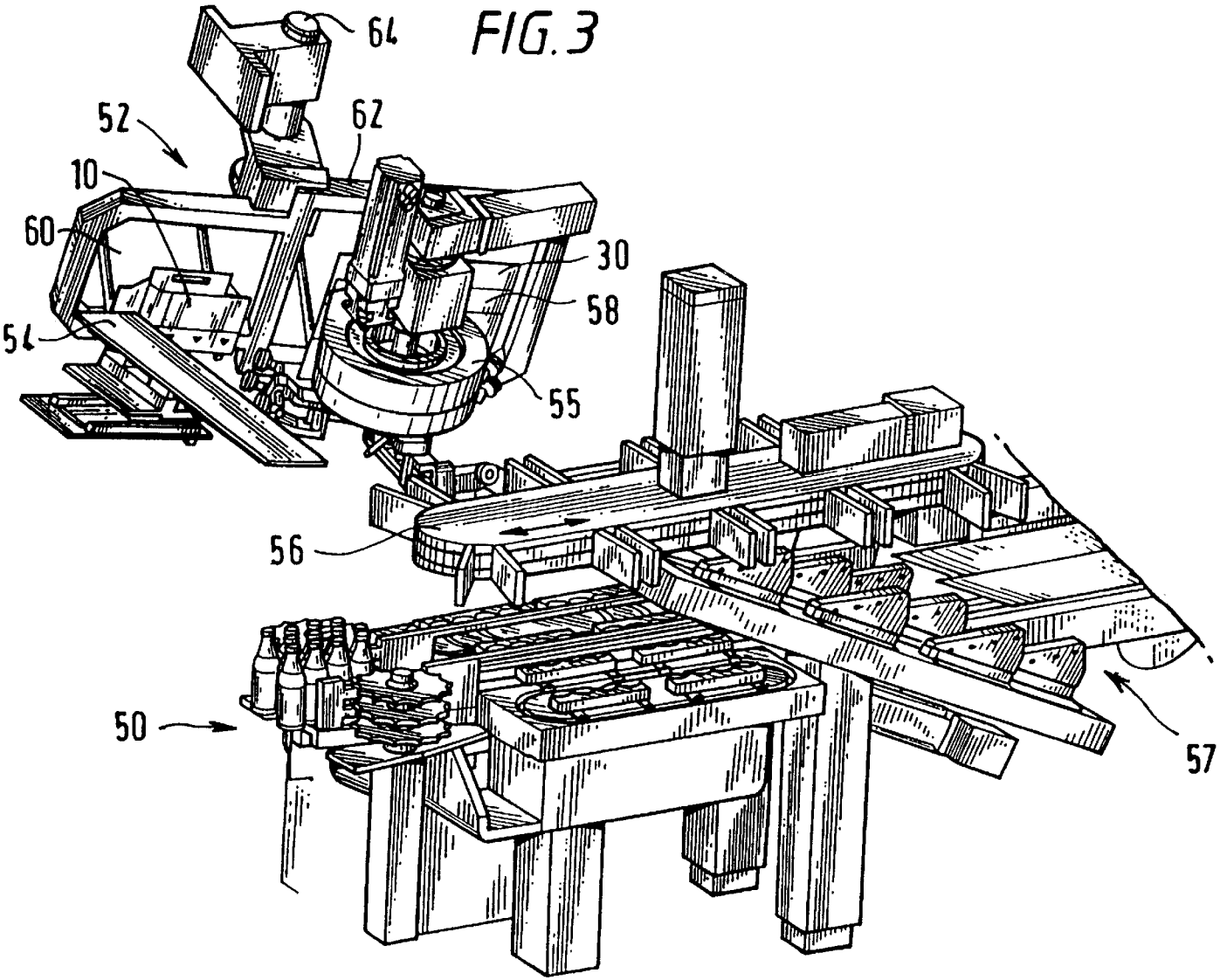
FIG. 3 is a perspective view of the infeed of a packaging machine illustrating the hopper unit and feed mechanism of a preferred embodiment of the invention.
Figure 4:
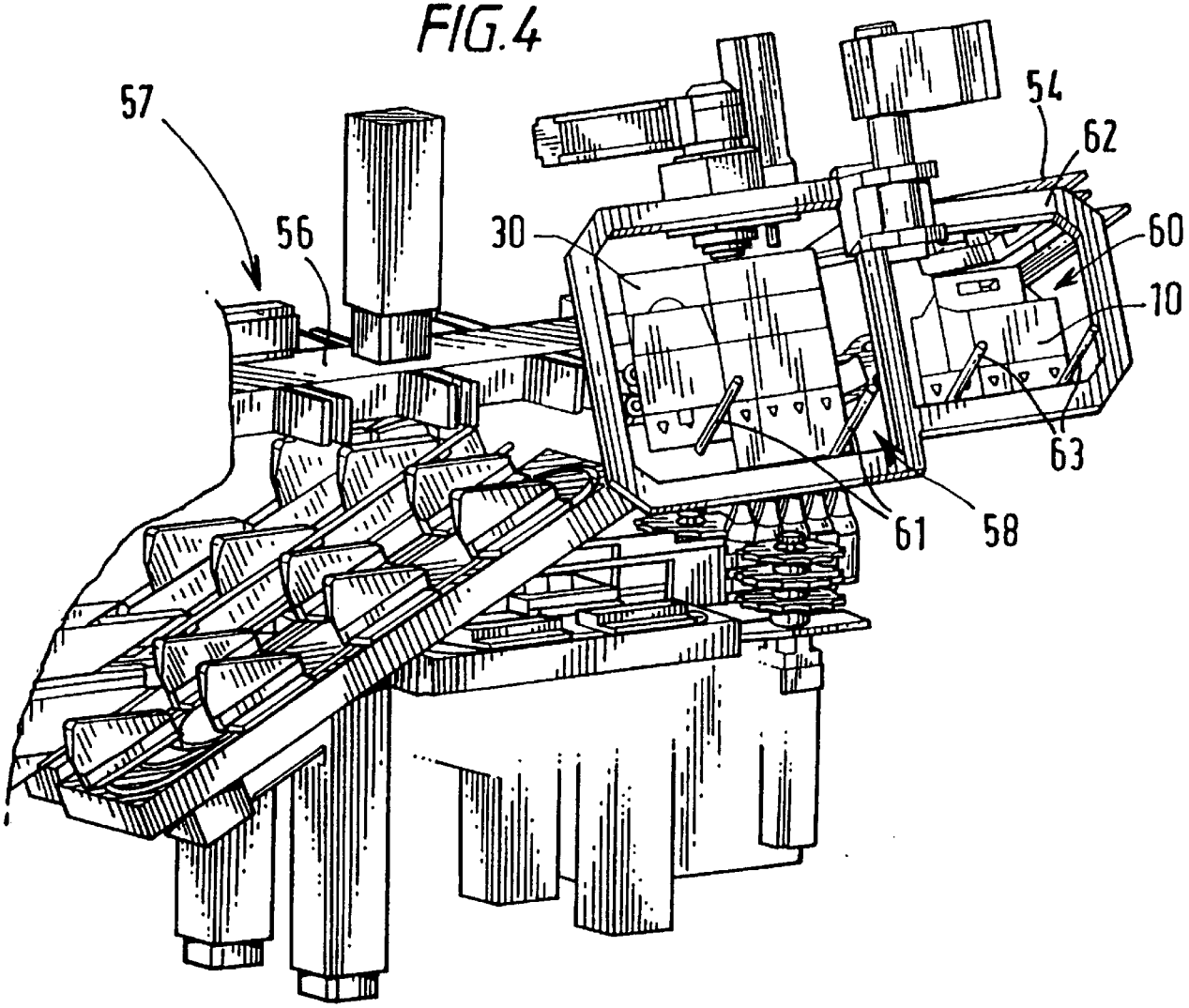
FIG. 4 is a perspective view from the opposing side of the packaging machine illustrated in FIG. 3.

Referring to FIGS. 3 to 4 of the drawings there is shown a machine 50 for processing cartons of the type outlined above. The upstream end of the machine includes a dual hopper 52 in which a multiplicity of basket type and fully enclosed cartons 10, 30 in a collapsed condition are held ready for processing. A back feeder of the type referred to in PCT Published Application WO99/14127 and a rotary vacuum feeder 55 are positioned adjacent the dual hopper 52. A paper feed chain 56 is provided to transfer cartons downstream to the loading station 57.

The hopper unit 52 comprises two or more separate hoppers 58, 60 in adjacent positions described in more detail with reference to FIGS. 3 to 6. Each hopper 58, 60 is mounted onto a frame 62, as shown in FIG. 3. The frame 62 is mounted onto a main shaft 64 which can be rotated about axis X—X shown in FIG. 5. Each hopper 58, 60 is a gravity feed type whereby the carton blanks are held in their respective hoppers at an incline to provide a positive feed. It is envisaged that the hopper unit can comprise more hoppers adapted to receive different carton types or sizes which are preferably located surrounding the rotary feeder hereinafter described.

In order for the blank to be transferred from the inclined position to a vertical plane, it is necessary to offset the axis of rotation of the rotary feeder 55 from the vertical plane, as illustrated in FIGS. 3 and 4.

Figure 5:
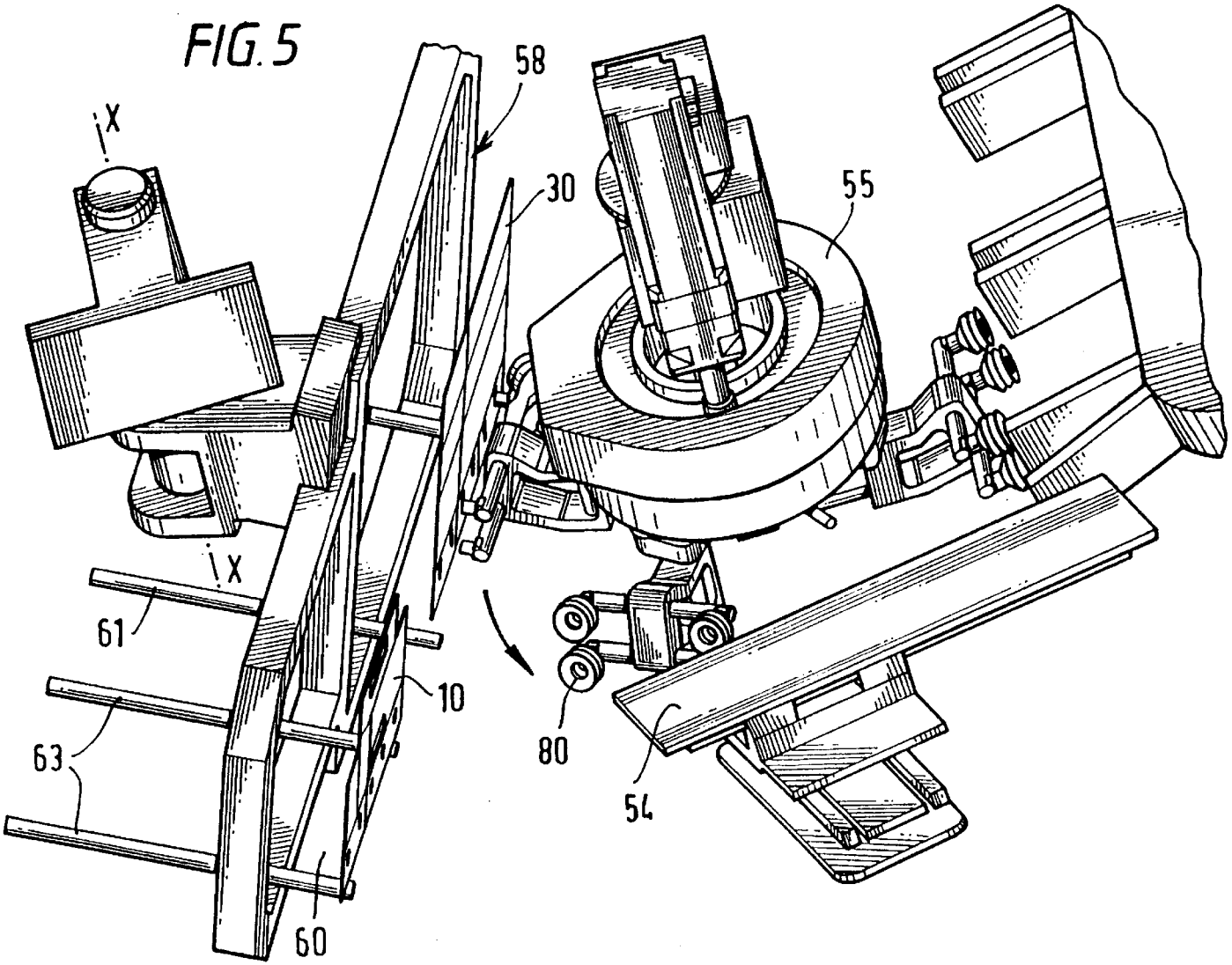
FIG. 5 is a perspective view of the invention illustrating the hopper unit in a first position.
Figure 6:
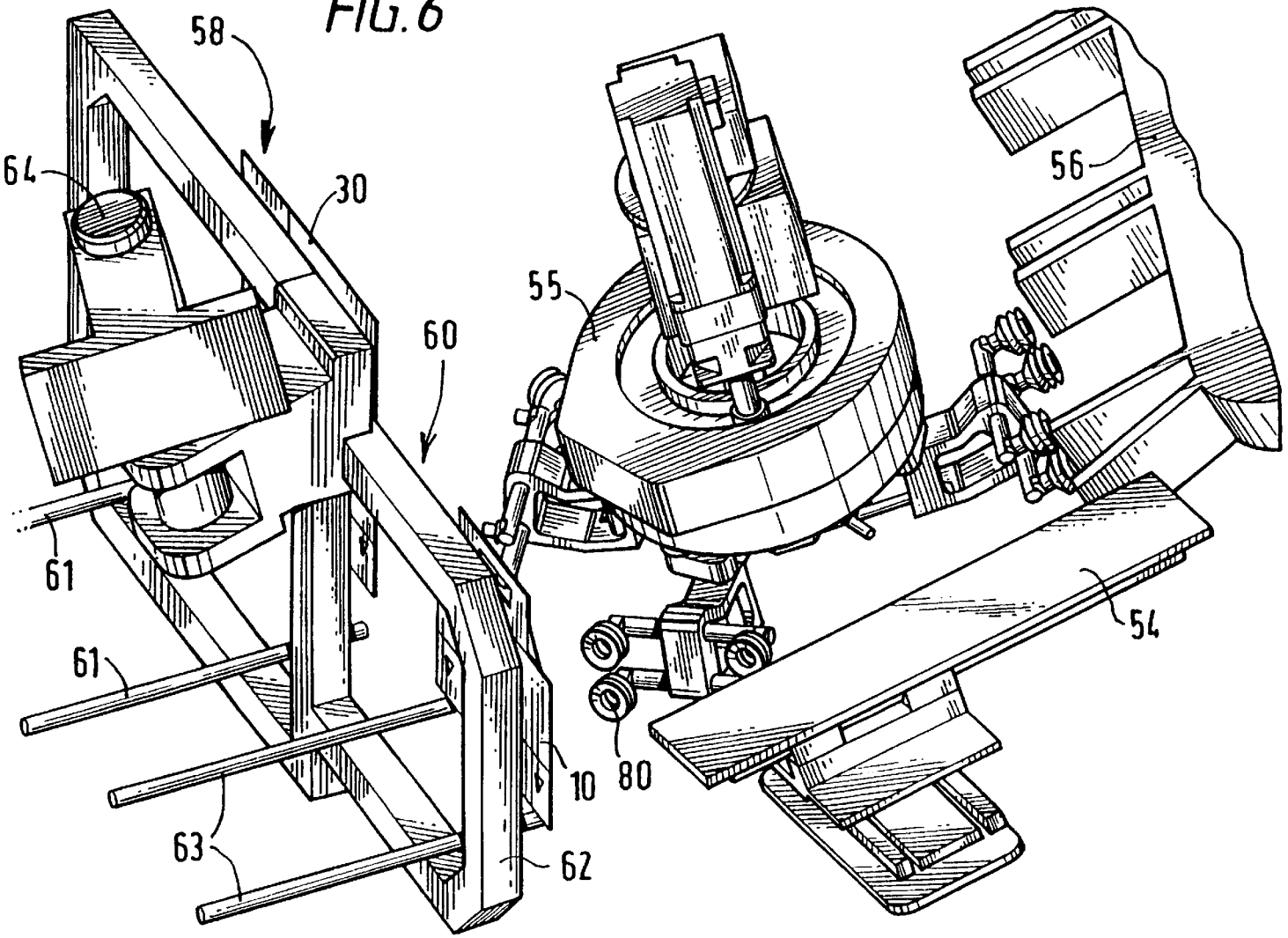
FIG. 6 is a perspective view of the invention illustrating the hopper unit in a second position.

In this embodiment, a pneumatic cylinder (not shown) is used to rotate the frame 62 between two positions: the first position, as shown in FIG. 5, with the first hopper 58 placed in an operative position ready for fully enclosed cartons 30 held in the first hopper 58 to be fed into the packaging machine. FIG. 6 illustrates the frame 62 in a second position with the second hopper 60, containing the basket type cartons 10 in an operative position.

Each hopper 58, 60 includes spaced support members 61, 63 respectively, to hold the cartons in a flat collapsed condition. The support members 61, 63 are fully adjustable to support different sizes and types of carton.

The position of the hopper is controlled by a control system described in PCT Published Application WO99/14120.

Figure 7:
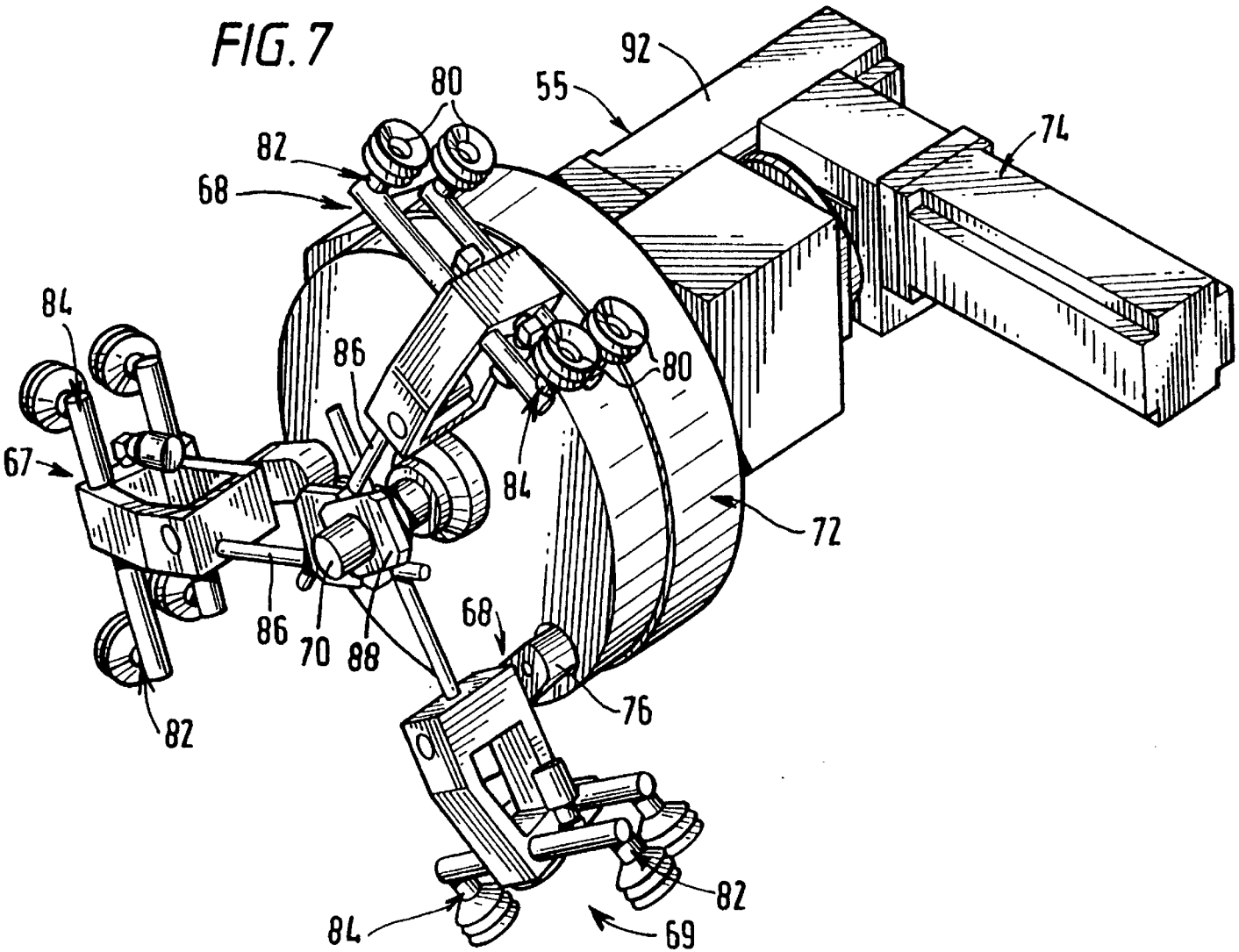
FIG. 7 is a perspective view of the feeder assembly shown in FIG. 3.
Figure 8:
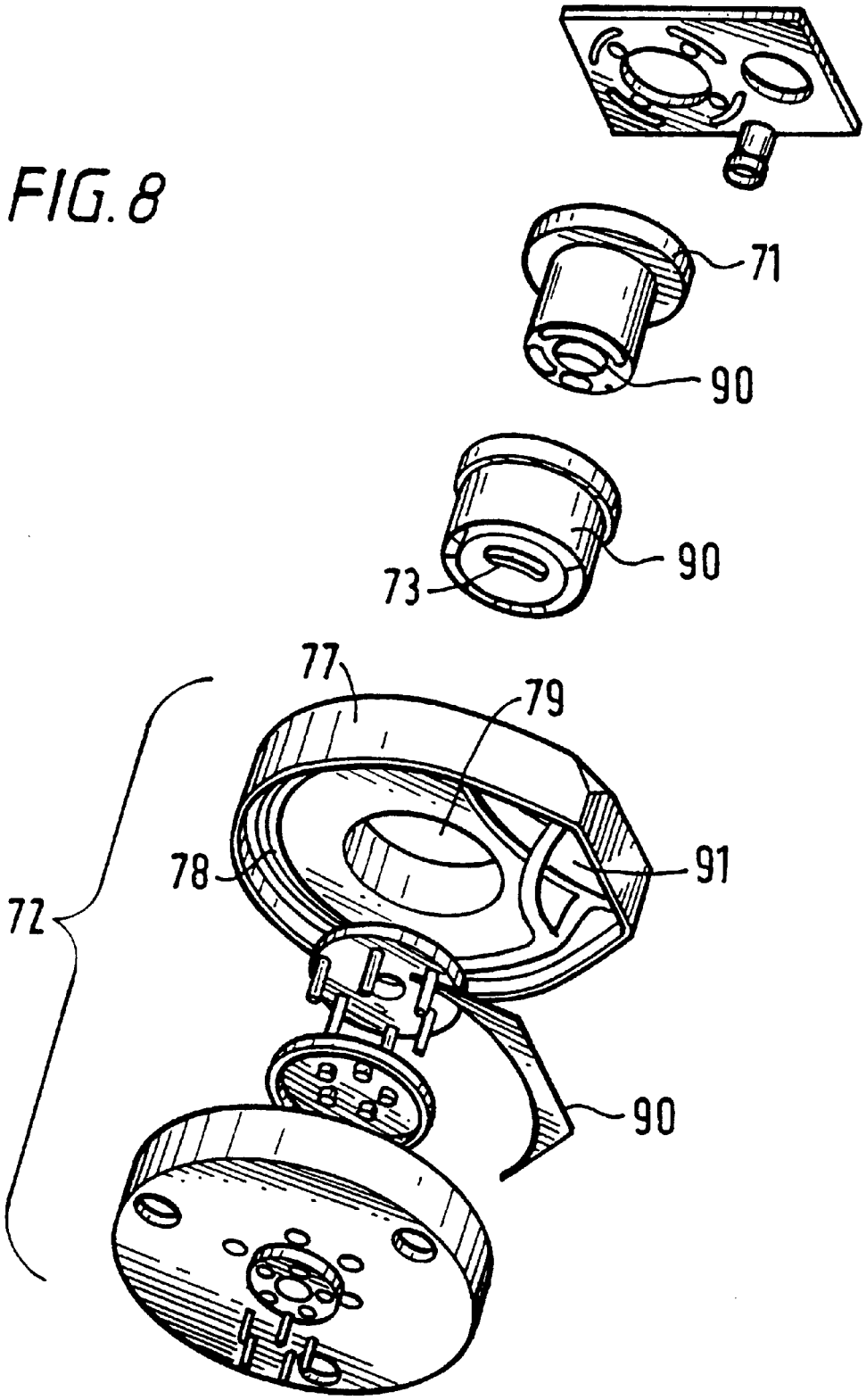
FIG. 8 is an exploded view of the feeder assembly of FIG. 7.

The construction of the rotary feeder 55 is illustrated in FIGS. 7 and 8. The feeder mechanism 55 according to this invention includes a main shaft 70 rotatable about a fixed axis. The shaft 70 is generally supported at its end by a suitable bearing structure 71, 73 but which is conventional and which is mounted to a side frame 72. Suitable driving mechanism, such as a servo motor 74 is provided to rotate shaft.

For withdrawing the lower most collapsed carton from the hopper unit, a pick up device 68 is provided including carton engaging means, for example suction cups 80 which are supported on cup holders and a frame 82 and 84 respectively. The cup holder frames 84 are preferably fixedly mounted respectively on an elongate support rod 86 which is slidably mounted respectively on a collar structure 88. The collar structure 88 is preferably rigidly secured to main rotatable shaft 70. The frames 84 are mounted onto cam rods 76 extending into the side frame 72 housing a cam track 78 hereinafter described. As illustrated from FIG. 7, in this embodiment there are three sets of carton pick up devices 67, 68, 69 provided in association with the main rotatable shaft 70. Only one set of such devices such as those indicated at 68 are described in detail because all three sets of pick up devices are of the same construction operating in an identical fashion.

FIG. 8 serves to illustrate an exploded view of the internal components of the side frame 72 the rotary vacuum feeder. In this embodiment a fixed cam plate 77 is mounted on the inner surface of side frame 72 and is provided with an aperture 79 through which the drive shaft 70 extends. A cam track 78 is formed in the fixed cam plate 77 with cam followers (not shown) disposed within the cam track 78. The purpose of the cam track 78 is to facilitate the cam rods 76 to be extended away from the main shaft 70 so that the suction cups come into contact with the carton thereby to remove one of the cartons from the operative hopper 58 and to rotate the carton in a uniform path to the paper feed chain 56. As the carton is rotated from its hopper 58, a back feeder 54 is used to separate opposing side panels and to assist in the erection of the carton.

A vacuum break 90 is provided in the feeder mechanism 55 which is used in conjunction with a vacuum supply to set the vacuum connection and cut off points, described below.

In use, the hopper unit is positioned so that one of the hoppers is in an operative position for example, the first hopper 58. Thereafter, the cartons are continuously and sequentially fed from the hopper 52 to the paper feed chain 56 by the main shaft 70 rotating the pick up device 68 in the direction indicated by the arrow, shown in FIG. 5. As the pick up devices 67, 68, 69 rotate, the suction cups 82 are extended to be moved into contact with a side wall 32 of the carton 30 by the path of the cam track. A vacuum is then applied to the set of suction cups 80. Thus, the carton 30 is withdrawn and then transferred to the paper feed chain 56. The vacuum is maintained during this transfer stage so that the suction cups 80 hold the carton wall 30. When the carton is deposited at the paper feed chain 56, a vacuum break 90 disconnects the vacuum supply from the suction cups to release the carton.

If it is desired to package a different carton type, for example a basket type carton 10 held in the second hopper, a number of adjustments are made to the machine. The second hopper 60 is rotated by the pneumatic cylinder about shaft 64 and placed in an operative position and corresponding hopper 58 is moved to a non-operative position. As the position of the second hopper 60 relative to the rotary feeder 55 is different to the first hopper 58, it is necessary to move the pick up (or carton engaging) point 91 of the suction cups shown in FIG. 8 and to alter the "on" and "off" positions of the vacuum supply. These changes are carried out by moving the cam track 78 and/or the vacuum breaks 90 controlling the supply of a vacuum to a second position. Suitable drive means, for example a servo motor 92 controlled by the control system moves these sub-assemblies between the two positions. It is preferred to include a third position for the vacuum supply: this position being the "default setting" whereby the vacuum supply is disconnected throughout the rotation of the suction cups 80. The default position is adopted during carton changeover or if there is a fault in the machine.

According to this invention the speed of operation of the apparatus is improved as well as its efficiency and durability as the carton is moved from a collapsed position to a fully set up condition. Of course, the final set up operation is due in part to engagement with a back feeder and a corner of the carton with the lugs which then affects complete and final set up of a carton whilst being held by the suction cup.

While the preferred embodiment described herein is for loading bottles into cartons, it will be recognised that the invention is not limited to cartons for bottles. The invention may be used with machines for packaging cans, paperboard "bricks" and other containers into cartons.

Moreover, while the preferred embodiment described herein is shown as part of a machine for loading containers into vertically-loaded sleeve-type carton, the invention is not limited to cartons of this type. As will be recognised by those skilled in the art, the invention may be used with wrap-around or end-loaded cartons.

It will be understood that the hopper and feeder mechanism of the invention has been illustrated with reference to a specific embodiment and that numerous modifications are possible within the scope of the invention. The hopper and feeder mechanism is able to process cartons comprising numerous configurations of groups of articles covering a range of carton size and shape, for example, four, six, eight and twelve bottles without undue time being spent in adjusting the mechanism.

What is claimed is:

1. An apparatus for use in a packaging machine including a carton conveyor, said apparatus for storing two different types of cartons and for selecting and transferring cartons to be packaged, comprising:

a first hopper for storing cartons of a first type;

a second hopper for storing cartons of a second type;

carton engaging and transfer means for engaging a carton held in one of said first and second hoppers and transferring the carton to the carton conveyor;

said carton engaging and transfer means being rotatable about a first fixed axis in an orbital path;

first means for locating said first hopper at a first position along said orbital path;

second means for locating said second hopper at a second position along said orbital path different from said first position;

said carton engaging and transfer means being located with respect to the packaging machine so that at least one point along the carton conveyor is located along said orbital path.

2. The apparatus of claim 1, further comprising control means for causing said first and second locating means to place a selected one of said hoppers into an operative position adjacent said orbital path.

3. The apparatus of claim 2, wherein said first locating means and said second locating means together comprise a frame rotatable about a second fixed axis, and wherein said first hopper and said second hopper are each mounted to said frame.

4. The apparatus of claim 3, wherein said control means causes the selected one of said hoppers to be placed into an operative position by rotating said frame about said second axis, thereby moving the other of said hoppers to an inoperative position.

5. A method of selecting a carton from one of a first and second hopper and transferring the carton to a packaging machine having a carton conveyor, comprising the steps of:

rotating a carton engaging and transfer means about a first fixed axis in an orbital path;

positioning a selected one of said first and second hoppers into an operative position along said orbital path;

engaging the with said engaging and transfer means; and transferring the carton along said orbital path from the selected one of said hoppers to the carton conveyor.

6. The method of claim 5, wherein said first and second hoppers are mounted to a frame rotatable about a second axis, and wherein the selected one of said first and second hoppers is positioned into said operating position by rotating said frame about said second axis.

* * * * *